United States Patent [19]

Damrau

[11] 4,310,573

[45] Jan. 12, 1982

[54] METHOD AND APPARATUS FOR SUPPLYING COATING TO A COATER

[75] Inventor: Wayne A. Damrau, Wisconsin Rapids, Wis.

[73] Assignee: Consolidated Papers, Inc., Wisconsin Rapids, Wis.

[21] Appl. No.: 174,248

[22] Filed: Jul. 31, 1980

[51] Int. Cl.[3] ..... B05C 11/02; B05C 1/00; B05D 3/12; B05D 1/28

[52] U.S. Cl. ..... 427/356; 118/123; 118/126; 118/249; 427/358; 427/428

[58] Field of Search ..... 427/356, 358, 428; 118/126, 123, 249

[56] References Cited

U.S. PATENT DOCUMENTS 3,486,482 12/1969 Hanger ..... 118/126 X
3,996,889 12/1976 Otten et al. ..... 118/126

*Primary Examiner*—Michael R. Lusignan
*Attorney, Agent, or Firm*—Gary, Juettner & Pyle

[57] ABSTRACT

A method and apparatus are disclosed for use with a paper coater located on a backing roll of, for example, a papermaking machine. In the method, apparatus in the form of a hinged bridge is used to collect excess coating liquid from a remote doctor blade or a first coater having such blade and supply the same to a second coater. The bridge may be mounted to the doctor blade or the first coater so that it can be placed in a bridging position accommodating various angles of the doctor blade, or in a second stored position wherein it will not interfere with the operation of either coater or the doctor blade.

17 Claims, 4 Drawing Figures

METHOD AND APPARATUS FOR SUPPLYING COATING TO A COATER

This invention relates to a method and apparatus for supplying coating liquid to a paper coater, and more particularly, to a method and apparatus for supplying excess coating from a remote doctor blade or a coater having a doctor blade to another coater located on the same backing roll.

THE PRIOR ART

It has been known to locate two paper coaters on a single backing roll of a papermaking machine, or an off-machine coater line. In such arrangement often each coater has been provided with separate supply piping connected to a coating supply system (comprising, as is conventional, pumps, pump motors, tanks, filters, controls, piping and valving) to supply coating liquid to the two coaters. Any coating not applied to the web by either of the coaters was usually collected from its respective coater and then returned, via separate piping to the coating supply system for reprocessing and eventual reuse. In such arrangement, with respect to the coating supply system, the two coaters were in parallel. In such parallel arrangement, the coating supply system had to be of sufficient size to meet the cumulative demands of both coaters.

Also it is known to use a single coater located on a backing roll in conjunction with a remote doctor blade, i.e., a doctor blade located a foot or more behind the coater, on the same backing roll, and to place a one piece, rigid bridging member between the doctor blade and coater to transfer excess coating from the doctor blade directly to resupply the coater. However, such rigid bridge as used in the past could not accommodate movement of the doctor blade to vary the angle at which the blade pressed against the backing roll. This shortcoming either limited the operating angle of the doctor blade, or made it necessary to change bridges if blade angle was to be changed. The former adversely affected the paper coating as it is an important parameter in producing good coated paper, and the latter resulted in the lost time.

BRIEF SUMMARY OF THE PRESENT INVENTION

The method and apparatus of the present invention utilizes apparatus in the form of bridge means which is hinged and adapted to be located between a coater and a remote doctor blade or another coater with such a blade, located on the same backing roll. The bridge is positionable between the coater and doctor blade to permit excess coating scraped off by the doctor blade to be collected and transferred or carried over to the coater to be supplied with coating liquid. The use of the hinged bridge permits the relationship of the doctor blade to the backing roll to be varied or adjusted without the need to change or adjust the bridge, the bridge adjusting automatically to the change of the relative positions of the blade and coater.

In the two coater arrangement, with the bridge in use, the two coaters are in series with each other, instead of in parallel so that a substantial reduction in the cost, size and complexity of the coating supply system can be made as it need be large enough only to meet the larger coating demand of the two coaters, instead of the sum of the two demands. For example, if the method and apparatus of the present invention were used with two identical coaters, since the coating supply system normally has sufficient excess capacity to provide the amount of coating actually being applied to the web by the two coaters, the coating supply system generally need not be any larger than if it served but a single coater. Whereas if the coaters were as used in the prior art, two coating supply systems or a single system with twice the capacity would have to be provided.

If the coaters are to be used independently, each coater may be provided with separate coating supply and collecting piping. While this increases the cost and complexity somewhat, the advantage of using a smaller coating supply system is retained, and flexibility of operation is gained. In such installation, the bridge may be positionable in a second position, wherein it will not transfer coating between the coaters and not interfere with the operation of either coater.

An object of the method and apparatus of the present invention is to reduce the cost and expense of the equipment needed to supply coating liquid.

Another object of the method and apparatus of the present invention is to collect the excess coating from one coater or a remote doctor blade and use it to supply another coater.

Still another object of the method and apparatus of the present invention is to supply coating to a coater from a doctor blade or another coater with such a blade, while being able to easily adjust the angle of the doctor blade to the backing roll.

Yet another object of the method and apparatus of the present invention is to provide a multipositionable bridge which in one position transfers coating between a coater and a remote doctor blade or another coater with such a blade, and in another position does not interfere with the operation of any coater or the doctor blade.

These and other objects of the method and apparatus of the present invention will become apparent from the following written description and accompanying figures of the drawings wherein:

DESCRIPTION OF THE PREFERRED EMBODIMENTS

Figure 1:
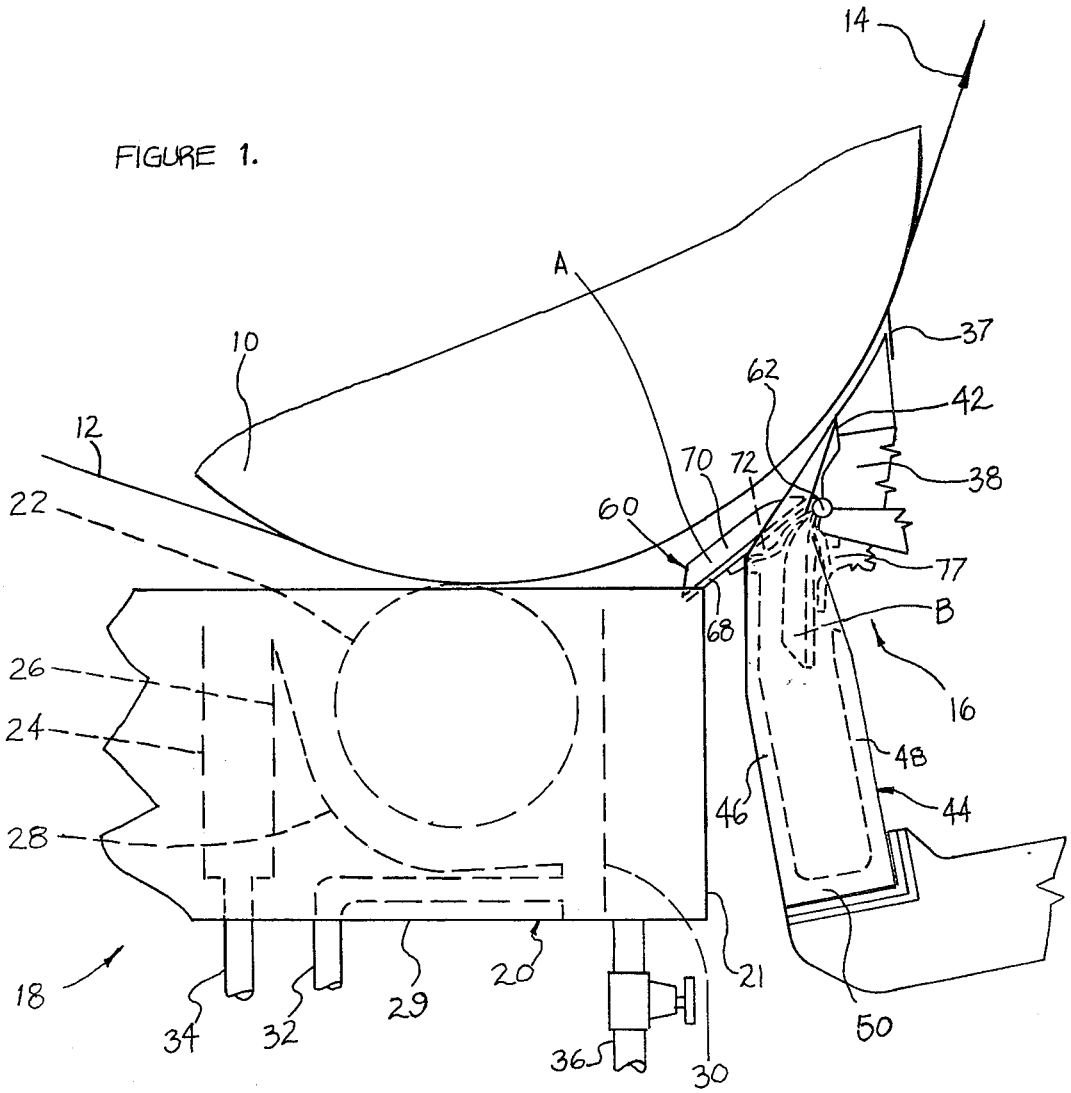
FIG. 1 is a side elevational view of a portion of a papermaking machine backing roll, two different type paper coaters being located on the one roll, and the bridge means of the present invention being shown in full lines in a first position, and in dotted lines in a second position.

Referring to FIG. 1, a backing roll 10 for a papermaking machine is illustrated. It should be understood that the roll 10 could also represent a roll on an off-machine paper coater line. As is illustrated, the roll 10 is wrapped at least partially by a paper web 12 which is being coated, the web in this instance moving in the direction of the arrowhead 14. One paper coater 16 is located adjacent the lower right-hand quadrant of the roll 10, and another coater 18 is located to the left and downwardly, at the bottom of the roll 10. Of course it is understood that the coaters 16 and 18 could be located elsewhere, or may be of different types.

In this instance, the other coater 18 is of a dip roll type, having a coating pan 20, which contains a rotatably mounted coating application roll 22. The pan has a front wall (not shown) and a rear wall 21. The coating pan 20 has baffeling in the form of a pair of vertical walls 24 and 26 and an arcuate section 28 which extends from the top of the wall 26 to below the roll 22, and then closes with the bottom 29 of the coating pan. Just to the right of roll 22 is another internal, vertical wall 30 which forms a rear baffel. The outer walls of the pan extend above the tops of the baffels to contain the coating.

If it is desired that the two coaters 16 and 18 be operable separately, a coating supply pipe 32 may be provided to supply coating to the coater 18 from the coating supply system (previously described but not shown). The pipe 32 extends through the bottom 29 of the pan 20. Excess coating may be withdrawn from the pan 20 by the pipe 34 located between baffels 24 and 26 and pipe 36 located behind the baffel wall 30. The pipe 36 has a valve 35 for regulating the rate coating flows from the pan through that pipe. While the coater 18 could be provided with a doctor blade, in this instance, it is not, but when operated alone or with the one coater 16, utilized a doctor blade 37 (FIGS. 1 and 3) carried by the one coater 16, the blade 37 being remote to the coater 18.

The one coater 16, which is only partially shown, when being utilized, may be supplied with coating from the coating supply system (not shown) by a piping system (not shown) to the upper or head portion 38 of the coater. When in operation, of the total coating supplied to the one coater 16, only a small portion, say 10% or less, is actually applied to the web 12, and the greater portion, say 90% or more, overflows the front wall 42 of the head portion 38. The head portion 38 of the one coater 16 is pivotally mounted by means (not shown) to pivot about a point to the right and below the portion 38, as shown in FIG. 1, so that it can be moved toward or away from the roll 10 and angularly, for among other reasons to vary the angle of the blade 37 to the roll.

The one coater 16 is equipped with an overflow pan 44 which has a front wall 46, a rear wall 48 and a bottom wall 50. The pan 44 is of a sweated construction, i.e., the walls 46, 48 and 50 being double walls, so that a fluid, such as cold water, may be circulated between the double walls of the pan to cause condensation of moisture, and prevent coating from accumulating on the same. Likewise, the overflow pan 44 is pivotally mounted by separate means (only partially shown) to pivot about a point generally to the right of the pan 44 at just below the level of coater portion 38, so it too can pivot toward or away from the roll 10 and also pivot toward or away from the head portion 38 of the one coater 16, as will be more fully described.

Figure 2:
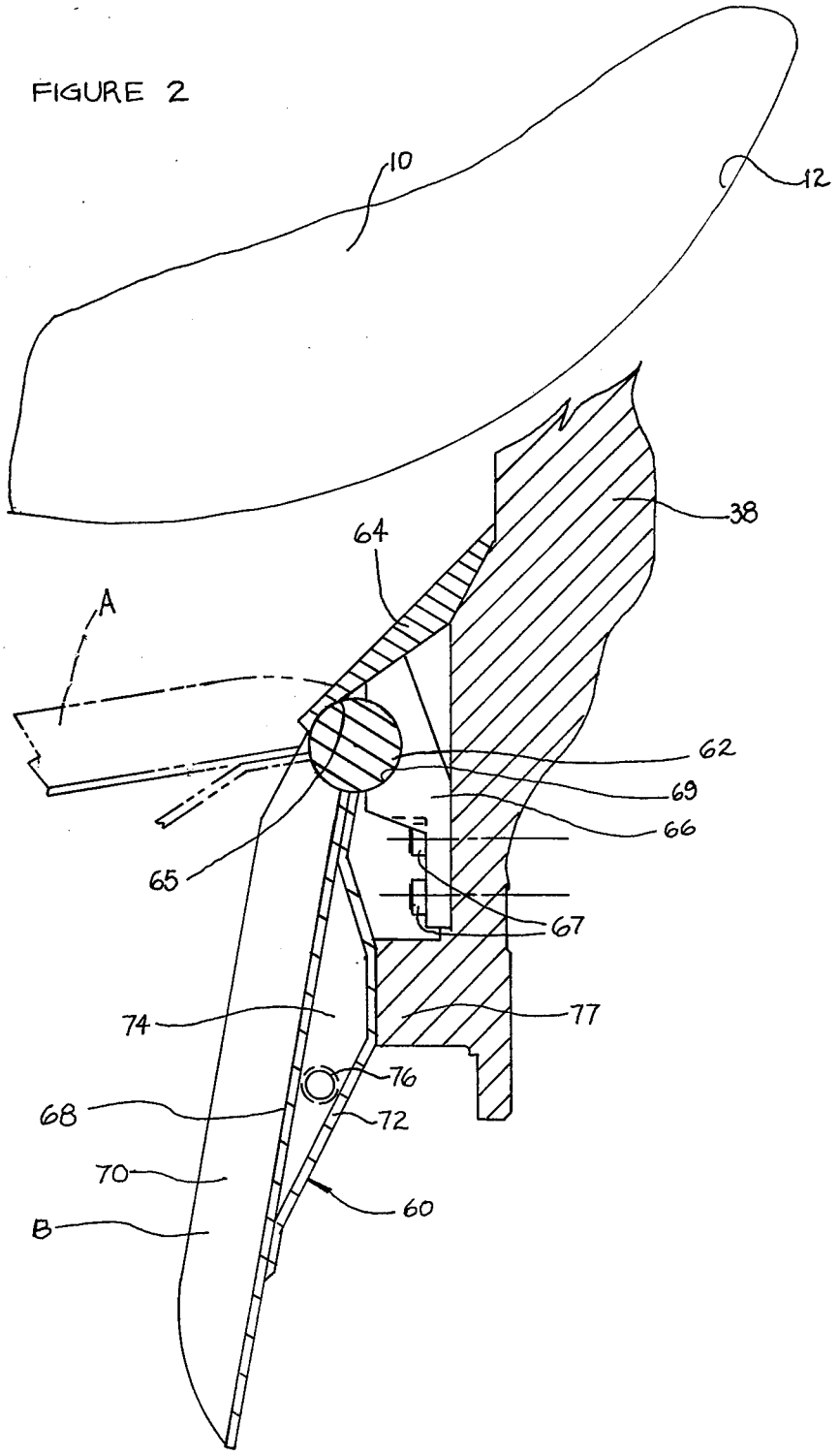
FIG. 2 is an enlarged cross-sectional view of a portion of FIG. 1, but with the bridge means shown in dotted lines in the first position and in full lines in the second position.
Figure 3:
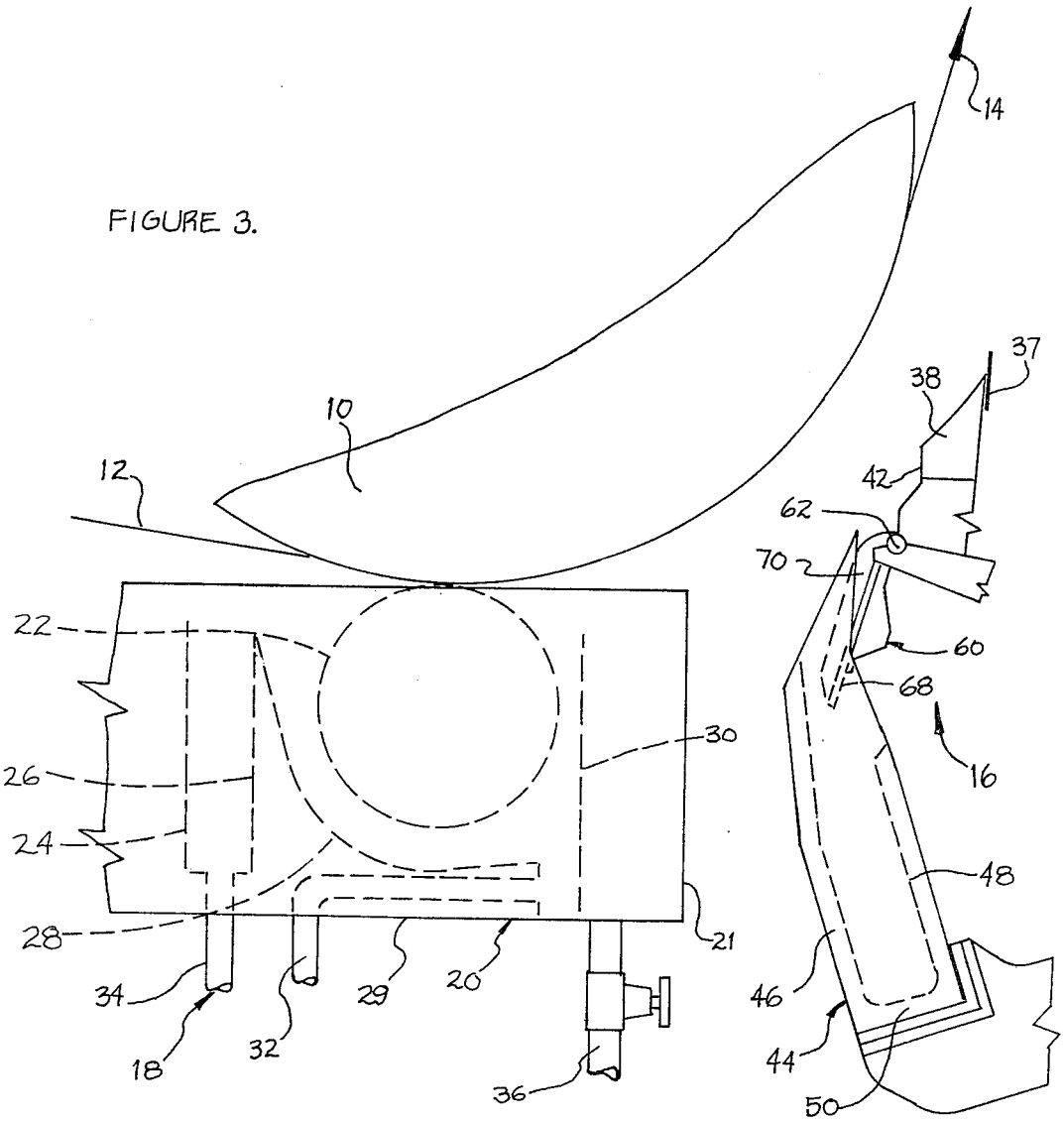
FIG. 3 is a view similar to FIG. 1, but with one of the coaters moved into a position permitting the bridge means to be moved between its first and second positions.

As shown in FIGS. 1–3, the one coater 16 has been provided with a first embodiment bridge means 60. The bridge means is shown in a first operating position designated by the letter A (full lines in FIG. 1 and dotted lines in FIG. 2) and in a second stored position, designated by the letter B (dotted lines in FIG. 1 and full lines in FIG. 2). Of course, bridge means, instead, could have been provided or mounted on the other coater 18 or other portions of the papermaking machine.

A more detailed view of the bridge means 60 is shown in FIG. 2. The bridge means at its upper end has a round bar or portion 62 which is engaged by portions of an elongated member 64 and a bracket 66 to pivotally or hingedly mount the bar 62, and in turn the bridge means 60, to the head 38 of the coater 16. The elongated member 64 is secured to the portion 38 of the coater 16 by conventional means (not shown), has a V-cut for engaging round bar 62, and functions to transfer the coating flowing over wall 42 onto the bridge. The bracket 66 is retained by bolts 67 and has a semi-circular cutout 69 for engaging bar 62. The V-cut 65 and cutout 69 circumscribe greater than 180°, and in this instance approximately 250°, of the bar 62 to retain it in place, but yet not interfere with the desired movement of the bridge. The construction of bridge 60 is such that it can be moved or pivoted on its bar portion 62 between its A and B positions, as will be hereinafter described, but yet prevents leakage of coating material at the joint provided by bar 62, member 64 and bracket 66.

The bar 62 at its lower left quadrant is secured, as by welding, to a flat pan or bottom 68 having at its sides turned up edges 70. Like the overflow pan 46, the flat pan portion 68 is of double wall construction, having a second wall 72 closed by a pair of end walls 74. One of the end walls 74 has an inlet opening 76, while the other (not shown) has an outlet (not shown), to accommodate the flow of cold water for condensing moisture and preventing an accumulation or build up of coating on the bridge. The inlet and outlet are connected by hoses to permit movement of the bridge 60. The wall 72 abuts a projection 77 on the head portion 38 to support the bridge 60 in its stored B position.

As shown in FIG. 1, the bridge 60 is long enough to extend from just below the front wall 42 of head portion 38 of the one coater 16, downwardly, beyond and over the upper edge of the rear wall 21 of the pan 20 of the other coater 18. Of course, the length and width of the bridge can be varied for the particular installation.

Referring to FIG. 3, in order to move the bridge 60 between the positions A and B, the one coater 16 is moved away from the backing roll 10 and the overflow pan 44 of the one coater is also lowered. When moved sufficient distances, it is possible to then pivot the bridge 60 so that it will clear the upper edge of the rear wall 21 of pan 20 and the upper edge of the front wall 46 of the overflow pan 44. After the bridge 60 is placed in the desired position by means (not shown), such as manually, pneumatically, electrically or hydraulically, the head portion 38 and overflow pan 44 of the coater 16 may be returned to their original positions. While not necessary, if desired, the overflow pan 44 can be raised to the position shown in FIG. 1, to support the bridge. Also, it is possible to use only the coater 16 with the coater 18 lowered from the backing roll 10. In such configuration, the bridge may be stored inside the overflow pan 44, and the overflow pan 44 raised close to the roll, (e.g. ¼ inch from the roll). In such configuration, the distance or gap between the top edge of the overflow pan and backing roll can be varied by moving or pivoting the overflow pan toward or away from the roll 10 to control coating flow.

Figure 4:
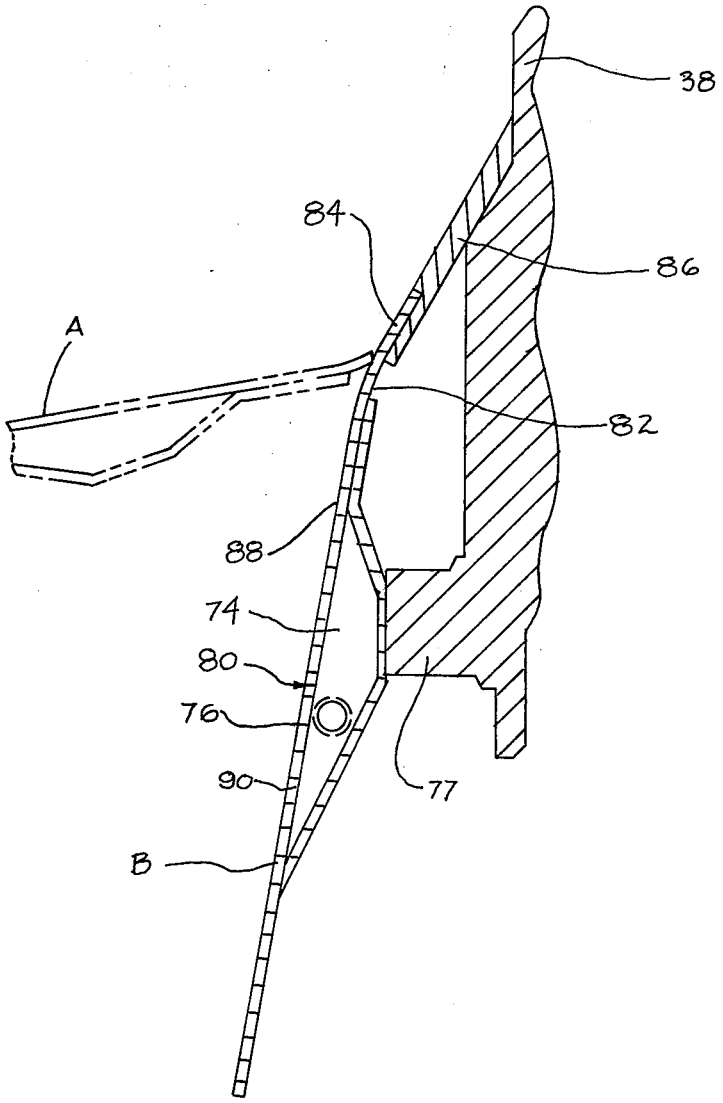
FIG. 4 is a view similar to FIG. 2, but of a second alternative construction for the bridge means.

Referring to FIG. 4, a second embodiment bridge 80 is shown. The portions of bridge 80 which are similar to bridge 60 and portions of the coater 16 and the surrounding environment which are similar, are identified by the same reference numbers are used previously.

Bridge 80 is similar to bridge 60, but instead of a pivot pin type hinge connection provided by rod 62, bridge 80 utilizes a flexible hinge 82. One end 84 of the flexible hinge 82 is secured or bonded to an extension 86 on the one coater, the extension 86 corresponding to the member 64. The other end 88 of the flexible hinge 82 is secured or bonded to the flat pan or bottom 90 of the bridge 80. The material for the flexible hinge should be selected to be compatible with the coatings to be used and for long life. For aqueous-clay coating, neoprene or butyal rubber is a suitable material. In all other respects, and in its operation, the bridge 80 is similar to the bridge 60.

As the operation of bridge 80 is similar to that for bridge 60, only operation of bridge 60 will be described. When the bridge 60 is in position B, it is stored in the overflow pan 44 of the one coater 16 and does not interfere with the flow of excess coating scraped off the web 12 by the doctor blade 37 into that pan. In the B position, either the one coater 16 or the other coater 18 in conjunction with remote blade 37 can be used independently, the provision of the bridge in no manner interferring with the operation of the coaters.

With the bridge in position A so that it is between the one coater 16 and the other coater 18, coating can flow from the coating supply system to coater 16 and then over the bridge to coater 18. While some of the coating would be applied to the web 12 by the one coater 16, most would overflow the front wall 42 of the one coater. From there it is intercepted by the bridge 60 and is carried downwardly by gravity across the bridge to the other coater 18 to supply the same with coating liquid. Again, some of the coating is applied to the web 12, while the excess coating from the second coater 18 is withdrawn from pan 20, returned to the coating supply system, reprocessed and then may be returned to the one coater 16.

Of course, the installation shown in FIGS. 1–3 permits either coater 16 or 18 to be used independently. In such instance, coating need be supplied only to the coater being used. If coater 18 is being used alone, it could be supplied with coating through pipe 32 or the supply for coater 16. In the latter instance, the coating would then flow across the bridge to coater 18. Or coater 18 could be supplied with coating from both sources. If coater 16 is being used alone, coater 18 can be lowered from the backing roll 10. The bridge 60 would be stored in the overflow pan 44, and only coater 16 is supplied with coating. Of course, when both coaters are being used, the coating can be supplied directly to coater 16 or 18 or both as desired.

Further, as the bridge 60 is pivotably or hingedly connected, it can readily accommodate movement of the head portion 38 to vary the angle the doctor blade 37 makes with the backing roll and web so that this important parameter can be easily varied. Thus, adjustments in blade angle can be readily made without stopping the papermaking machine and/or changing bridges.

As is apparent, the present invention has greatly reduced the size and capacity of the required coating supply system. In fact, in an installation where both coaters are to always be run simultaneously, the overflow pan 44 for the one coater 16 and separate supply piping 32 for the other coater 18 can also be completely eliminated.

For purposes of simplicity, the invention was described only in conjunction with two coaters. However, it should be understood that it is just as applicable to a single coater and a remote doctor blade located on the same backing roll above the coater. In such installation coating would be supplied to the coater from the coating supply system, applied to the web, the excess scraped off by the remote doctor blade, transferred to the bridge, and by gravity returned to the pan of the coater. Also, the pan could be equipped with some means for withdrawing some of the coating from the pan for reprocessing by the coating supply system and then returned to the pan. The hinged bridge means would have one end fixed, preferably to portions carrying the remote doctor blade. Thus, the remote doctor blade's position relative to the backing roll or web could be adjusted, and the hinged bridge means would automatically compensate for the change.

While only the preferred embodiments of method and apparatus of the present invention have been illustrated and described, from the foregoing it should be understood that variations, modifications and equivalent steps and structures therefor fall within the scope of the appended claims.

What is claimed is:

1. In apparatus for coating a web of moving paper, including a coater and an angularly movable, remote doctor blade both located on the same backing roll, said doctor blade being located above said coater, a coating supply system for supplying coating, said coater being adapted to apply coating to the web, and said doctor blade being adapted to scrape excess coating from the web, the improvement comprising bridge means for collecting excess coating from said doctor blade and transferring the excess coating by gravity to said coater, said bridge means having two portions hingedly connected together to accommodate the change of the relative angular position of said doctor blade on the web, one of said two portions of said bridge means being mounted to move with one of said coater and remote doctor blade, and the other of said two portions of said bridge means extending from said one portion to the other of said coater and remote doctor blade, whereby angular position of said doctor blade can be changed with said bridge means automatically compensating for such change and said coater is at least partially supplied with coating transferred by said bridge means from said remote doctor blade.

2. In the apparatus of claim 1, wherein said one portion of said bridge means moves with said remote doctor blade and said other portion of said bridge means extends to said coater.

3. In the apparatus of claim 1, comprising a second coater providing said doctor blade, said second coater being adapted to apply coating to the web between said first mentioned coater and said doctor blade, said coating supply system supplying coating directly to said second coater, said doctor blade also being adapted to scrape and collect excess coating applied by said second coater from the web, said bridge means transferring the excess coating of said second coater to said first coater.

4. In the apparatus of claim 3, wherein said coating supply system is sized to supply only the larger coating requirement of said two coaters.

5. In the apparatus of claim 3, wherein said one portion of said bridge means is mounted to said second coater.

6. In the apparatus of claim 5, wherein said other portion of said bridge means is pivotable relative to said second coater.

7. In the apparatus of claim 3, wherein said bridge means further comprises a bottom pan portion and a pivot rod portion at the upper end of said bottom pan portion, said pivot rod portion being pivotally mounted to said second coater, said bottom pan portion extending from said pivot rod portion to said first coater.

8. In the apparatus of claim 3, wherein said bridge means further comprises a bottom pan portion and a flexible hinge portion, said bottom pan portion being secured to said flexible hinge portion, and said flexible hinge portion, in turn, being secured to said second coater, said bottom pan portion extending from said flexible hinge portion to said first coater.

9. In the apparatus as in claim 3, further comprising an overflow pan at the front of said second coater, said first coater also including a pan, said bridge means being pivotally mounted on one of said two coaters, said bridge means being positionable in one position wherein said bridge means intercepts the coating from said second coater before it can reach said overflow pan of said second coater and transfers the coating to said pan of said first coater, and said bridge means being positionable in a second position wherein said bridge means is storable within said overflow pan of said second coater and does not interfere with the flow of excess coating into said overflow pan of said second coater or the operation of either of said two coaters or said doctor blade.

10. In the apparatus of claim 9, wherein said second coater is pivotally mounted relative to said backing roll, and said overflow pan is pivotally mounted relative to said second coater and said backing roll, and with said bridge means in its second position, said overflow pan may be pivoted toward said backing roll to establish a gap with said backing roll to control the flow of coating from said second coater.

11. In the apparatus of claims 1 or 3, wherein said bridge means further comprises a bottom pan portion of double wall, sweated construction, and inlet and outlet means for circulating fluid between said double walls to prevent coating from accumulating on said bridge means.

12. In the apparatus of claim 1, wherein said bridge means further comprises a bottom pan portion and a pivot rod portion at the upper end of said bottom pan portion, said bottom pan portion being mounted by said pivot rod portion to pivot relative to said doctor blade, and said bottom pan portion extending from said pivot rod portion to said coater.

13. In the apparatus of claim 1, wherein said bridge means further comprises a bottom pan portion and a flexible hinge portion, said bottom pan portion being secured to said flexible hinge portion, said flexible hinge portion, in turn, being mounted to permit said bottom pan portion to pivot relative to said doctor blade, and said bottom pan portion extending from said flexible hinge portion to said coater.

14. A method of operating a pair of coaters, one of which has a doctor blade thereon, and both of which are located on a single backing roll, for applying coating to a web of paper being run on the backing roll, comprising the steps of:

a. supplying an excess of coating to one of the coaters;
b. applying at least a portion of the coating to the web with the one coater;
c. collecting the excess coating which was supplied to but not applied to the web by the one coater;
d. collecting the excess coating which was supplied to and applied to the web by the one coater with the doctor blade;
e. transferring by gravity the collected coating from the one coater to the other coater to at least partially supply the other coater with coating; and
f. applying at least a portion of the coating to the web with the other coater.

15. The method of claim 14, further comprising the steps of:

g. collecting the excess coating which was applied to the web by the other coater with the doctor blade;
h. transferring by gravity the collected excess coating which was applied to the web by the other coater back to the other coater;
i. reprocessing at least a portion of the coating supplied to the other coater, and
j. returning the reprocessed coating to the one coater.

16. In apparatus for coating a web of paper moving on a backing roll, including a first coater having a coating pan and an applicator roll rotating within said coating pan, and a second coater with an angularly movable doctor blade at its rear and an overflow pan at the front of said second coater, both coaters and said doctor blade being located on said backing roll, said second coater being located above said first coater, said doctor blade of said second coater also being located above said coating pan of said first coater, a coating supply system for supplying coating to either of said coaters, said coaters being adapted to apply coating to the web, and said doctor blade being adapted to collect excessing coating from the web, the improvement comprising bridge means for transferring said excess coating collected by said doctor blade by gravity into said coating pan of said first coater, whereby the collected and transferred coating can be applied to the web by said applicator roller of said first coater, said bridge means having two portions hingedly connected together to accommodate the change of the relative position of said second coater and doctor blade on the web, one of said two portions of said bridge means being mounted to move with said second coater and doctor blade, and the other of said two portions of said bridge means being adapted to extend from said one portion to said coating pan of said first coater, said bridge means being positionable in one position with said bridge means intercepting the collected coating from said second coater before it can reach said overflow pan of said second coater and transferring the coating into said coating pan of said first coater, and said bridge means being positionable in a second position with said bridge means storable within said overflow pan of said second coater so that it does not interfere with the flow of excess coating into said overflow pan of said second coater or the operation of either of said coaters or doctor blade, said coating supply being sized large enough to supply coating to said second coater, but of insufficient size to supply both of said coaters, if in parallel, with coating, whereby: the size of said coating supply may be substantially smaller than if said first and second coaters were in parallel, the angular position of said doctor blade on the web can be changed and said bridge means automatically compensating for such change, and said coating pan of said first coater may be supplied with coating transferred across said bridge means from said second coater.

17. In the apparatus of claim 16, wherein said bridge means further comprise a bottom pan portion and a flexible hinge portion, and said flexible hinge portion, in turn, being secured to said second coater, said bottom pan portion extending from said flexible hinge portion to discharge into said coating pan of said first coater.

* * * * *